US005373693A

United States Patent [19]

Zarzalis et al.

[11] Patent Number: 5,373,693

[45] Date of Patent: Dec. 20, 1994

[54] BURNER FOR GAS TURBINE ENGINES WITH AXIALLY ADJUSTABLE SWIRLER

[75] Inventors: Nikolaos Zarzalis, Dachau; Franz Joos, Munich, both of Germany

[73] Assignee: MTU Motoren- Und Turbinen-Union Muenchen GmbH, Germany

[21] Appl. No.: 111,424

[22] Filed: Aug. 25, 1993

[30] Foreign Application Priority Data

Aug. 29, 1992 [DE] Germany ..... 4228816

[51] Int. Cl.[5] ..... F02C 9/00; F23R 3/14

[52] U.S. Cl. ..... 60/39.23; 60/748

[58] Field of Search ..... 60/39.23, 39.24, 737, 60/740, 748; 239/402.5, 403, 405

[56] References Cited

U.S. PATENT DOCUMENTS

| | | | |
|---|---|---|---|
| 2,655,787 | 10/1953 | Brown | 60/39.23 |
| 3,899,881 | 8/1975 | Arvin et al. | 60/737 |
| 3,930,368 | 1/1976 | Anderson et al. | 60/39.23 |
| 3,930,369 | 1/1976 | Verdouw | 60/39.23 |
| 4,263,780 | 4/1981 | Stettler | 60/748 |
| 4,534,166 | 8/1985 | Kelm et al. | 239/402.5 |
| 4,726,182 | 2/1988 | Barbier et al. | 60/748 |
| 4,754,600 | 7/1988 | Barbier et al. | 60/748 |
| 4,825,641 | 5/1989 | Mandet et al. | 60/39.23 |
| 4,842,197 | 6/1989 | Simon et al. | 239/403 |

FOREIGN PATENT DOCUMENTS

| | | |
|---|---|---|
| 0251895 | 1/1988 | European Pat. Off. . |
| 2442895 | 7/1986 | Germany . |

*Primary Examiner*—Timothy S. Thorpe

*Attorney, Agent, or Firm*—Evenson, McKeown, Edwards & Lenahan

[57] ABSTRACT

A burner for gas turbine engines is provided in which a ring-shaped swirling device is coaxially assigned to a fuel nozzle. The swirling device forms tangential ducts for an adjustable feeding of combustion air between profiles arranged along the circumference. In this case, the profiles are to be formed by corresponding sections of components which are arranged to be axially movable relative to one another. One respective section of a profile is to be a hollow body in which the corresponding other section engages in a movable manner. With the burner, a combustion is made possible that is low in pollutants while the swirling efficiency and the rotational swirl development are optimal.

16 Claims, 3 Drawing Sheets

BURNER FOR GAS TURBINE ENGINES WITH AXIALLY ADJUSTABLE SWIRLER

BACKGROUND AND SUMMARY OF THE INVENTION

This invention relates to a burner and, more particularly, to a burner for gas turbine engines having a ring-shaped swirling device which is coaxially assigned to a fuel nozzle. The swirling device forms tangential ducts between profiled surfaces distributed along the circumference for an adjustable feeding of combustion air.

In the case of modern burners and combustion chamber designs for gas turbine engines, a combustion that is low in pollutants is endeavored, particularly in the primary zone of the combustion chamber. It was found that a significant reduction of the emission of pollutants can be achieved in the case of a comparatively low combustion temperature of $<1{,}900°$ K by means of a comparatively high proportion of air with respect to the fed fuel in the primary zone.

In addition, relatively low pollutant emissions require, among other things, a uniform processing of the fuel-air mixture to be supplied to the primary zone as well as good combustion efficiency. This is particularly true in the case of burners known according to German Patent Document DE-PS 24 42 895 which operate with air support as "low-pressure systems" with a high fuel atomization efficiency and a partial wall-side and aerodynamic fuel evaporation. However, the known case does not provide swirling devices which can be adjusted with respect to the air flow rate in order to control different operating conditions with respect to correspondingly required variable fuel-air flow rates, in a manner that is as low in pollutants as possible.

Furthermore, combustion chamber concepts which, in the interest of a combustion that is low in pollutants, provide a "variable chamber geometry" in order to supply combustion air and possibly mixed air by way of holes of the rows of holes are high in construction expenditures, technically complex, susceptible to disturbances and expensive. These devices can be controlled in their cross-sections by pipe sections of the flame tube jacket of the combustion chamber which can be displaced relative to one another in the axial or circumferential direction.

From European Patent Document EP-PS 0251895, an annular combustion chamber for a gas turbine engine is known. In this case, for a combustion that is low in pollutants, an "external" swirling device is assigned to each burner which can be regulated with respect to the supply of a portion of the combustion air.

In the known case, the regulating takes place via a screen which can be rotated on the outside on a central body in the circumferential direction and which has webs on openings distributed along the circumference. The webs, according to their length, project only partly into radial/tangential openings of the central body. The webs project in such a manner that, in intermediate positions of the screen, they each have an angular position which deviates from the openings. In the intermediate positions which are decisive for the regulating, a guiding of the duct is obtained which throttles the air flow at the inlet, is divergent in the direction of the flow and expands abruptly downstream of the trailing edge of the web in the direction of a large-surface duct outlet. In the process, the respective circumferential component of the flow at the respective outlet of an opening is clearly weakened in the, manner of a separating diffuser flow, whereby the required generating of the swirl is impaired considerably. This is a significant disadvantage with respect to obtaining a uniform development of turbulence which is required during the whole, operating condition and a resulting uniform and stable combustion that is low in pollutants.

There is therefore needed a burner of the initially mentioned type wherein in a relatively simple manner, at least one swirling device permits over a large control range the air flow rate operationally required for a combustion which is uniform and low in pollutants while a uniformly pronounced rotational swirl is maintained.

According to the present invention, these needs are met by a burner for gas turbine engines having a ring-shaped swirling device which is coaxially assigned to a fuel nozzle. The swirling device forms tangential ducts between profiled surfaces distributed along the circumference for an adjustable feeding of combustion air. The profiled surfaces are formed by corresponding sections of components which are arranged to be axially movable relative to one another. One respective section of a profiled surface is a hollow body in which the corresponding other section engages in a movable manner.

According to the present invention, the sections which form the profiles or profiled surfaces are arranged in an axially projecting manner on mutually opposite faces of two, possibly ring-shaped, or annual-disk-shaped components. Preferably, the profile sections constructed as hollow bodies may be designed to be relatively thin-walled and to be precisely coordinated with the outer profile geometry of the profile sections of the respective other components which can be axially moved into it.

In the case of the present invention, an axial profile lengthening or shortening is virtually obtained during the relative adjustment with the significant advantage that the recesses which are in each case mutually opposite between the profile sections, develop axially enlargeable or reducible cross-sections of the swirling ducts. This occurs in suck a manner that in all positions, along the whole duct length, flow cross-sections exist which are always maintained to be constant. The front wail course of the hollow-body-type, section which projects slightly in intermediate positions or in the maximally opened end position presents no significant aerodynamic "obstacle". In the case of the present invention, swirling ducts are constructed with respectively continuous square or rectangular cross-sections. The possibility exists to construct the profile sections and thus the profiles and swirling ducts to be radially/tangentially curved in the circumferential direction.

The aerodynamic impairments or disadvantages which were mentioned with respect to the known prior art do not occur either on the inflow or on the outflow side. Despite the adjustment in the sense of a change of the air flow rate, a speed profile exists which, on the outlet side, is uniform along the circumference.

Therefore, because of the indicated characteristics, the swirling flow and thus the desired rotational swirl geometry, which is also responsible for an optimal processing of the fuel/air mixture, will not be impaired in the different intermediate positions.

Using the adjustable swirling device, the whole or a significant portion of the primary air which is required for a combustion that is low in pollutants can be supplied. The swirling device can be adjusted for the flow rate of relatively small and relatively large amounts of air.

In an advantageous further development, the present invention permits the combination of at least one controllable or adjustable swirling device with a stationary swirling device which makes available a constant air supply during the whole operating condition. The fuel supply is varied depending on the load condition, in which case an air supply is "superimposed" on the variable operating conditions which, while being adapted to the respective operating conditions, meets the air requirement with respect to a combustion that is low in pollutants. The latter air requirement may be regulated, for example, as a function of an operationally increasing combustion temperature and/or, pressure in the combustion chamber.

The present invention includes the possibility of burning, for example, stoichiometrically, in certain engine conditions, as well as dependent on the design and use spectrum of the engine, i.e. during the igniting and the start of the operation as well as, possibly, during an extreme full load. The invention also provides burning, predominantly in the cruising operation, with a large amount of air and therefore in a manner that is low in pollutants.

The concerned swirling devices may generate in approximately the same direction or in mutually opposite directions rotational or mixed air swirls which rotate with respect to the burner axis or nozzle axis.

Other objects, advantages and novel features of the present invention will become apparent from the following detailed description of the invention when considered in conjunction with the accompanying drawings.

DETAILED DESCRIPTION OF THE DRAWINGS

Figure 1:
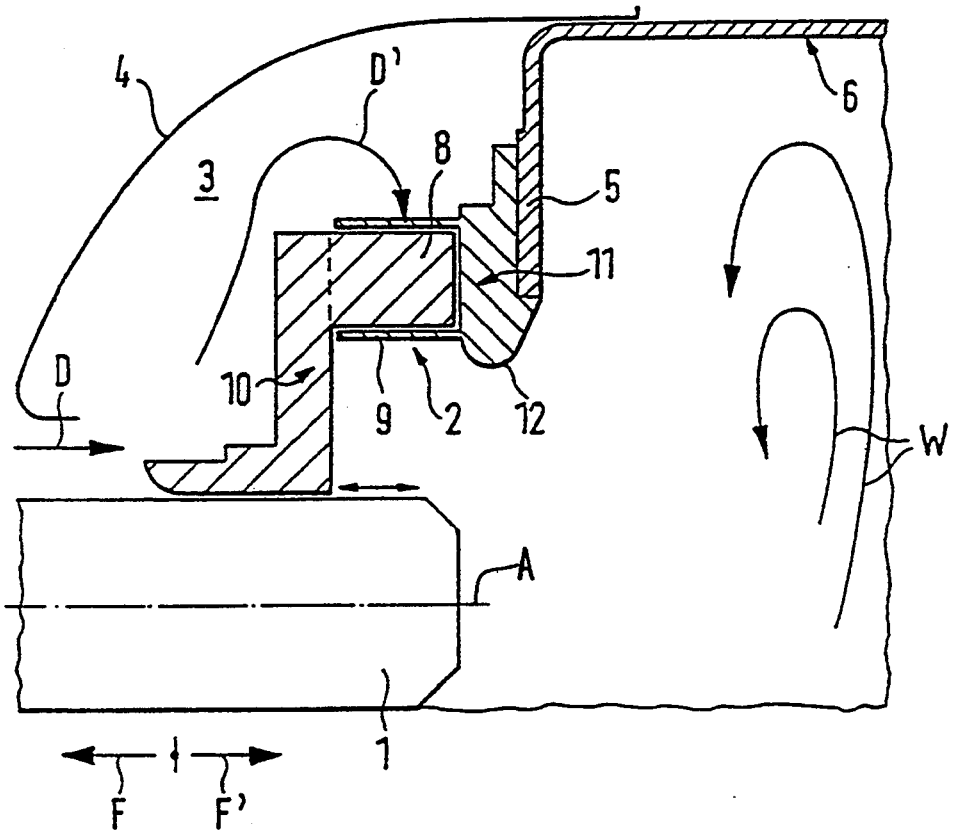
FIG. 1 is a longitudinal sectional center view of a flame tube section of a gas turbine engine which is illustrated in a broken-off manner, together with the upper half of a swirling device according to the present invention arranged on the fuel nozzle in a first end position in which the overall smallest flow cross-section of the swirling ducts is obtained.

According to FIG. 1, a ring-shaped swirling device 2 is coaxially assigned to a fuel nozzle 1 in the case of a burner of a gas turbine engine. It will be understood that all directions used herein are in reference to an axis extending axially through the fuel nozzle 1 unless otherwise indicated. In this case, a portion of the air removed at the compressor end flows according to arrow D as primary air first in the axial direction of the engine into an upstream annulus 3 constructed at the head end of the combustion chamber. By way of the annulus 3, the fed primary air D is fed from above and from the outside in the radial direction of the engine over the component 10 of the swirling device 2 after being locally deflected according to the direction of the arrow D'. The component 10 is frontally closed in itself. The annulus 3 is formed between a closing hood 4 as well as, viewed from the left to the right, a section of the fuel nozzle 1, the swirling device 2 and the rear, wall 5 of the flame tube 6 of the combustion chamber.

Figure 4:
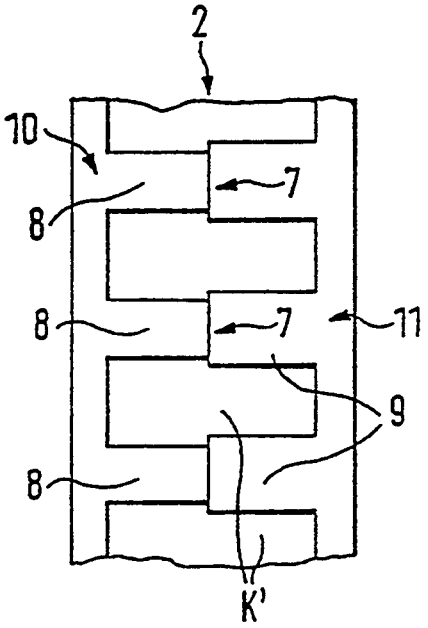
FIG. 4 is a schematic top view, in sections, developed into the plane of the drawing, of the swirling device in the second end position according to FIG. 2.

As illustrated particularly by the completely opened end position according to FIG. 4, the profiles 7 of the swirling device 2 which are arranged to be distributed uniformly along the circumference are formed by corresponding sections 8, 9 which each project axially with respect to the engine from mutually opposite faces of two annular-disk-shaped components 10, 11.

In this case, one section 9 of a profile 7 is constructed as a hollow body 20 (see also FIG. 5) into which the respective other section 8 can be moved axially more or less far in the axial direction of the engine. Thus, sections 8 engage in an axially movable manner in the other sections 9. In the case of an axial adjustment of at least one component 10, variable radial/tangential swirling ducts K (FIG. 3) and K' (FIG. 4), respectively, which have flow cross-sections which remain constant along their whole length and are rectangular in this case can be adjusted between the profiles 7. In the end position according to FIG. 3, sections 8, 9 of the profiles 7 are axially moved completely into one another so that the respective swirling ducts K form the smallest possible overall flow cross-section of the swirling device. This contrasts with the end position according to FIG. 4 in which the swirling ducts K' make available the largest possible overall flow cross-section.

Figure 3:
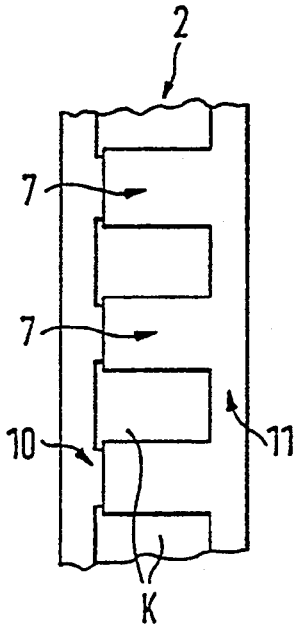
FIG. 3 is a schematic top view, in sections, developed into the plane of the drawing, of the swirling device in the first end position according to FIG. 1.

Particularly in contrast to the embodiment according to FIGS. 3 and 4, within the scope of the invention, an arrangement would be possible in the case of which hollow bodies and full profiles follow one another in sections continuously in the circumferential direction on each face of a component 10 and 11.

Figure 2:
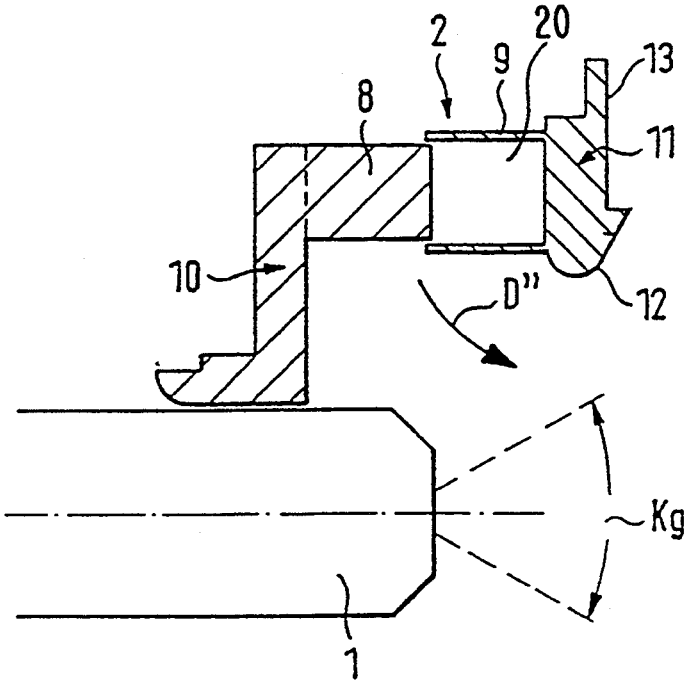
FIG. 2 is a sectional representation according to FIG. 1, wherein the swirling device is illustrated in a second end position having the overall largest flow cross-section of the swirling ducts.

According to FIGS. 1 and 2, it is also assumed that one component 11 is fixedly connected with the combustion chamber, in this case, therefore, with the rear wall 5 of the flame tube 6. Component 11 is centered on the rear wall 5 and firmly anchored via a recess 13 ending in a radially interior nose edge 12. The nose edge 12 forms a guide for the duct which is convergent/divergent in the direction of the flow.

As also illustrated in FIGS. 1 and 2, the other component 10 is radially arranged, by way of a sleeve-shaped section, on the inside slidable or adjustable in the axial direction on the fuel nozzle. The other component 10 may also be axially adjustable on a cylindrical nozzle carrier or nozzle assembly.

According to another further development, the fuel nozzle 1 or its housing jacket is axially adjustable in the axial direction (arrows F, F') in order to achieve along the whole adjusting range of the swirling device 2, a positioning of the fuel spray cone Kg which is optimally coordinated with the respective flow-off direction of the swirled primary air D'' (FIG. 2). This allows a rotational swirl W (FIG. 1) to be generated in the primary zone which is optimally enriched with fuel and is uniform along the circumference of the swirl in the extremely different end positions of the swirling device 2 according to FIGS. 3 or 4.

Figure 5:
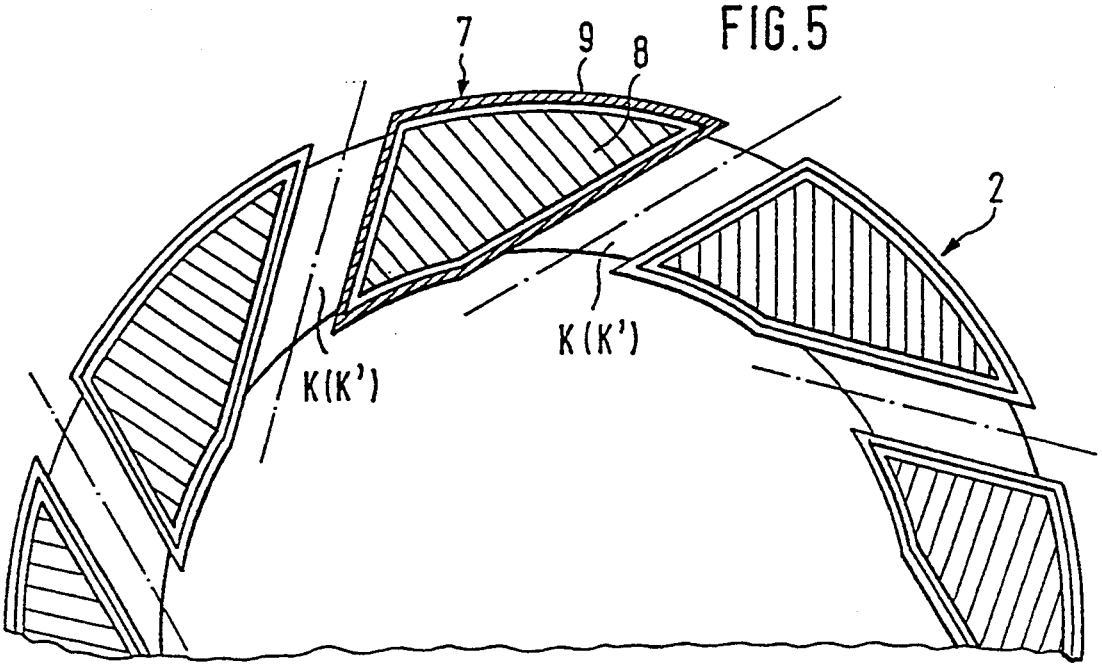
FIG. 5 is a partial circumferential cross-sectional view of the swirling device in the first end position shown in FIG. 3 illustrating the essentially wedge-shaped profile sections as the hollow bodies of one component, i.e., the component on the right in FIGS. 1 or 3, with profile sections of the other or left component moved into it.

FIG. 5 clearly illustrates the construction and arrangement of the essentially triangular profile sections 8 as thin-walled hollow bodies inside the geometrically correspondingly adapted profile sections 9. The profile sections 8, 9 have cross-sections which taper in a wedge shape in the direction from the outside to the inside diameter (outlet side) of the swirling device, while enclosing the swirling ducts K and K' which are uniformly and evenly distributed along the circumference, in this case, in a straight tangential construction.

However, within the scope of the present invention, the swirl ducts and/or the profile sections may also be constructed to be curved or may be constructed in the manner of blade ducts and/or in a blade shape.

Figure 6:
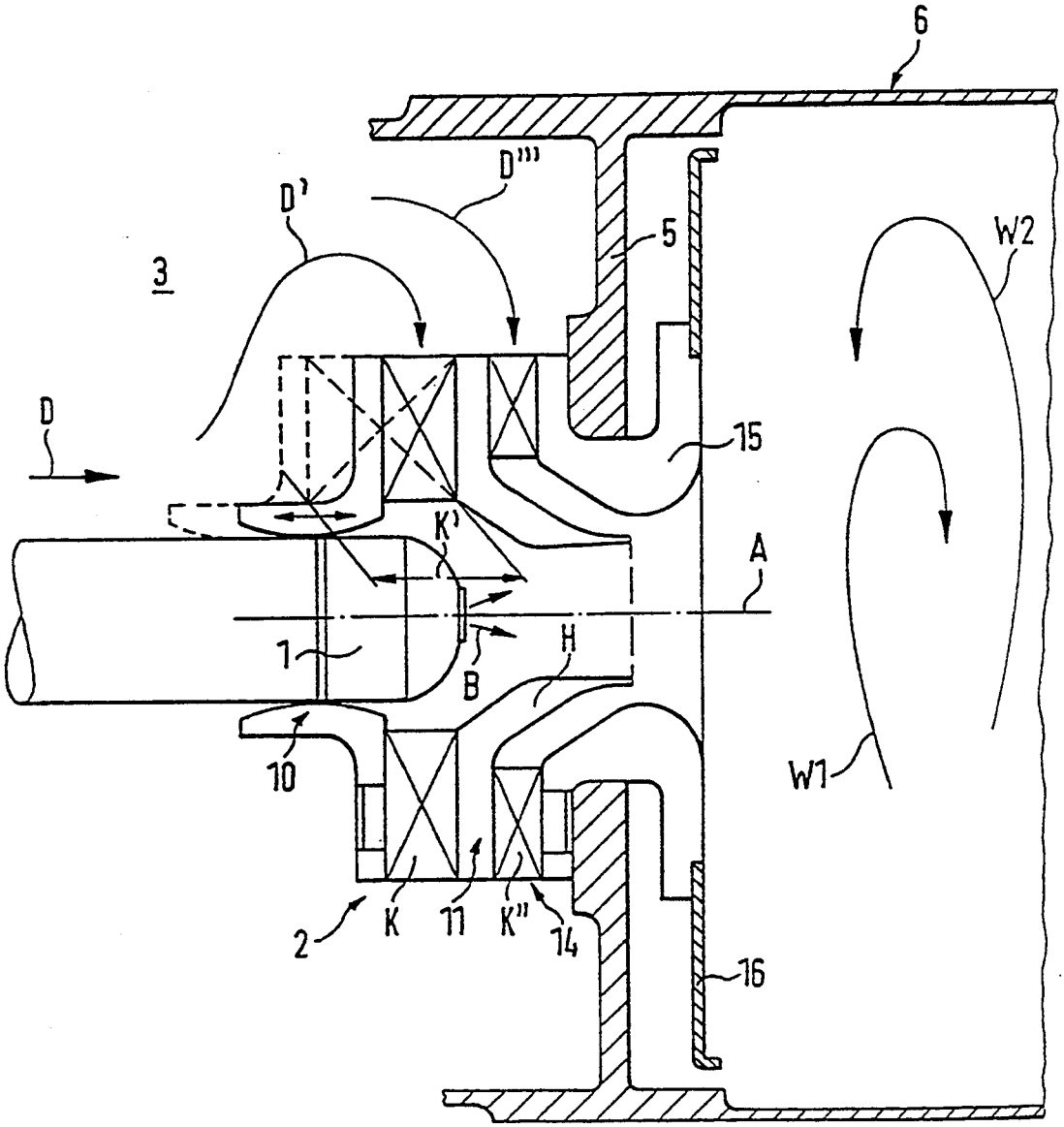
FIG. 6 is a longitudinal sectional center view of a head end of a combustion chamber illustrated on the flame tube side in a locally broken off manner, having a burner assigned to the central fuel nozzle, which comprises the combination of an adjustable and another stationary swirling device.

FIG. 6 illustrates another embodiment of the invention with a burner constructed on the head end of the combustion chamber in combination with a swirling device 2. The, swirling device 2 can be adjusted in the sense of FIGS. 1 to 5. A stationary swirling device 14 is arranged behind the swirling device 2. A radial inflow (arrow D''') is supplied from the primary air D flowing-in in the axial direction.

In contours illustrated by the solid lines, the adjustable swirling device 2 represents the end position with the respective smallest overall flow cross-section according to ducts K, in the sense of FIGS. 1 and 3. This is in contrast to the largest overall flow cross-section shown by an interrupted line and with the ducts K' which in this case are maximally opened in the sense of FIGS. 2 and 4.

According to FIG. 6, the adjustable swirling device 2 has the annular-disk-type component 10 arranged to be axially displaceable or adjustable on the fuel nozzle 1 and has the sleeve-shaped inner shaft and the sections 8 (FIG. 2 and 4) that can be moved axially into the sections 9 (FIG. 4, 5) of the other component 11 which are constructed as hollow bodies. The other or stationary component 11 forms a shielding wall in FIG. 6 which separates the swirling ducts K, K'' from one another and which extends downstream radially/axially in the shape of a sleeve (H) as well as coaxially to the nozzle axis or burner axis A. By way of respective fixed profiles, which form the swirling ducts K'' of the stationary swirling device 14, the fixed component 11 of the adjustable swirling device 2 is held centrally and firmly by way of a deflecting piece 15 on the flame tube rear wall 5 or on the combustion chamber housing. The deflecting piece 15'' has a convergent/divergent radially interior wall contour which is also rotationally symmetrical to the nozzle axis or burner axis A. Radially on the outside, the deflecting piece 15 is continued as the shielding wall 16 at a distance axially with respect to the rear wall 5.

By way of the two swirling devices 2, 14 (FIG. 6), rotational swirls W1, W2 may be generated in the primary zone which are rotated in the same rotational direction or in opposite directions to one another and which are enriched with fuel B from nozzle 1 or mixed intimately.

In the end position of the swirling device 2 which is illustrated fully open by an interrupted line, in combination with the stationary swirling device 14, a combustion in the primary zone can be achieved which is extremely rich in air or "cold" and low in pollutants.

The axial adjustment of one of the two components, for example component 10, of the adjustable swirling device 2 may take place by hydraulically, pneumatically or electrically actuated adjusting devices.

Particularly in the case of an annular combustion chamber with burners which are arranged at the head end to be distributed uniformly along the circumference, there is the possibility for such an operation that a rotatory adjusting movement of a common ring by way of levers as well as oblong-hole slot guides, the latter in each case arranged obliquely to the burner axis, is in each case converted into an axial adjusting movement.

In the case of a corresponding axial adjustment of the at least one component, such as 10, the corresponding swirling device 2 can adjust or control the air flow rate as a function of the engine load condition from individual engine parameters or variables or as a function of locally measured pressure and temperature courses in the combustion chamber.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A burner having a fuel nozzle for gas turbine engines, comprising:

a ring-shaped swirling device coaxially arranged radially outward from a longitudinal axis through said fuel nozzle, said swirling device having an outer and an inner annular surface;

flow ducts equidistantly spaced along a circumference of said ring-shaped swirling device for an adjustable feeding of combustion air, said flow ducts extending through said swirling device from the outer to the inner annular surface thereof in a skewed direction with respect to a radial from said longitudinal axis;

said ring shaped swirling device including two ring members, each having profiled sections formed by profiled surfaces extending in an axial direction of said burner, said flow ducts being formed between opposingly facing radially extending ones of said profiled surfaces;

wherein corresponding profiled sections formed by said profiled surfaces are arranged to be axially movable relative to one another by said two ring members;

wherein one of said corresponding profiled sections is a hollow body into which the other said corresponding profiled section engages in a movable manner such that said flow ducts maintain a constant cross-section over their entire axial length for adjustment between minimal and maximal flow rates of said combustion air.

2. A burner according to claim 1, wherein all of said corresponding profiled sections of the profiled surfaces which are constructed as hollow bodies are arranged on one of said two ring members.

3. A burner according to claim 1, wherein one of said two ring members is held on a combustion chamber in a stationary manner and the other of said two ring members is arranged in an axially displaceable manner on one of the fuel nozzle and a nozzle carrier.

4. A burner according to claim 2, wherein one of said two ring members is held on a combustion chamber in a stationary manner and the other of said two ring members is arranged in an axially displaceable manner on one of the fuel nozzle and a nozzle carrier.

5. A burner according to claim 3, wherein said one ring member only has the corresponding profiled sections constructed as hollow bodies.

6. A burner according to claim 1, wherein both of said two ring members are arranged in a rotationally symmetrical manner with respect to the longitudinal axis and are constructed to be at least one of essentially annular-disk-shaped and sleeve-shaped.

7. A burner according to claim 2, wherein both of said two ring members are arranged in a rotationally symmetrical manner with respect to the longitudinal axis and are constructed to be at least one of essentially annular-disk-shaped and sleeve-shaped.

8. A burner according to claim 1, wherein both of said two ring members form rectangular variable ducts with flow cross-sections which always remain constant along their total length, said cross-sections being formed by the corresponding profiled sections.

9. A burner according to claim 1, wherein the fuel nozzle is arranged in an axially adjustable manner in said engine.

10. A burner according to claim 2, wherein the fuel nozzle is arranged in an axially adjustable manner in said engine.

11. A burner according to claim 3, wherein the fuel nozzle is arranged in an axially adjustable manner in said engine.

12. A burner according to claim 1, wherein the profiled surfaces have one of a wedge-shaped, triangular and blade-type cross-section.

13. A burner according to claim 2, wherein the profiled surfaces have one of a wedge-shaped, triangular and blade-type cross-section.

14. A burner according to claim 3, wherein the profiled surfaces have one of a wedge-shaped, triangular and blade-type cross-section.

15. A burner according to claim 1, wherein at least one stationary swirling device is arranged coaxially downstream of the ring-shaped swirling device in such a manner that a rotational swirl from each swirling device is generated in a primary zone.

16. A burner according to claim 2, wherein at least one stationary swirling device is arranged coaxially downstream of the ring-shaped swirling device in such a manner that a rotational swirl from each swirling device is generated in a primary zone.

* * * * *